United States Patent [19]

Parviainen

[11] Patent Number: 4,598,745

[45] Date of Patent: Jul. 8, 1986

[54] FEEDING WOOD CHIPPING

[75] Inventor: Jaakko Parviainen, Helsinki, Finland

[73] Assignee: Perusyhtymae Oy, Helsinki, Finland

[21] Appl. No.: 578,972

[22] Filed: Feb. 10, 1984

Related U.S. Application Data

[63] Continuation-in-part of Ser. No. 362,271, Mar. 26, 1981, abandoned.

[30] Foreign Application Priority Data

Mar. 18, 1981 [FI] Finland ..... 810844

[51] Int. Cl.[4] ..... B27L 11/02

[52] U.S. Cl. ..... 144/176; 83/62.1; 83/72; 83/251; 241/35; 241/92

[58] Field of Search ..... 144/176; 241/35, 92, 241/278 A; 83/62, 62.1, 72, 250, 251

[56] References Cited

U.S. PATENT DOCUMENTS

| | | | |
|---|---|---|---|
| 3,524,485 | 8/1970 | Smith | 144/176 |
| 3,916,742 | 11/1975 | Biernot | 83/251 |
| 4,077,287 | 3/1978 | Makeev et al. | 83/251 |

*Primary Examiner*—W. D. Bray

*Attorney, Agent, or Firm*—Ralf H. Siegemund

[57] ABSTRACT

Wooden logs are chipped by alternating forward feed of the log towards a cutting device, to obtain cutting and retracting the log from the cutting device, either as instigated manually or when the cutter speed drops below a predetermined value.

3 Claims, 4 Drawing Figures

Fig. 2
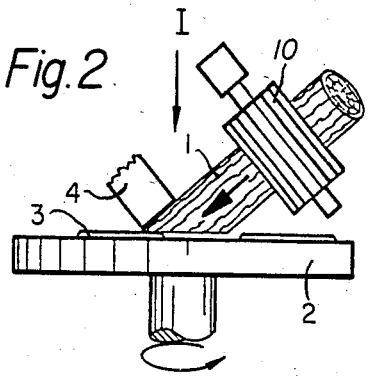
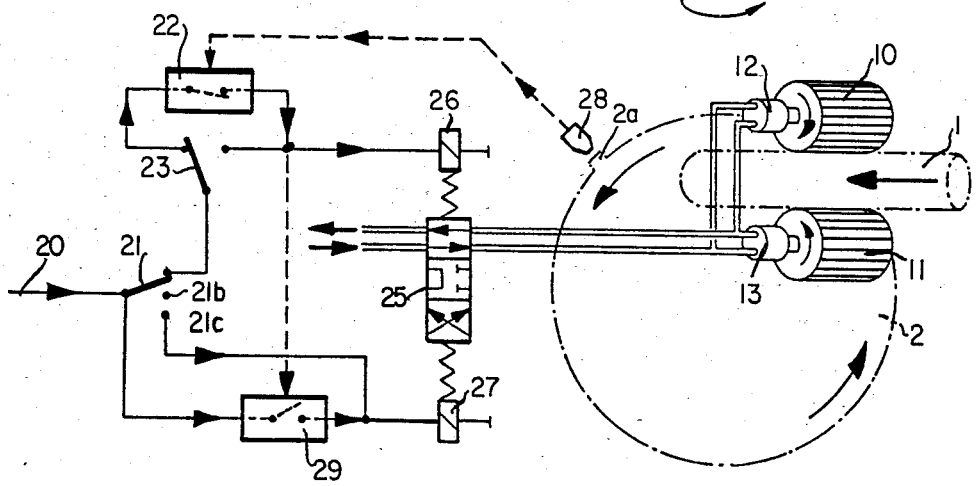
Fig. 4

FEEDING WOOD CHIPPING

BACKGROUND OF THE INVENTION

This application is a continuation-in-part of Ser. No. 362,271 filed 3/26/81 now abandoned.

The present invention relates to the control of feeding, for example, wooden logs to a movable chipping apparatus which includes hydraulically driven feed motors or the like.

Upon using a movable wood chipping apparatus, particularly for chopping or chipping entire logs of wood, the power of the motor providing traction is not always sufficient to continuously chop such a log or even to sustain the load established when several logs are to be chipped. This holds particularly true if the tractor engine or the like is used for this operation. Unless feeding is intermittently stopped the number of revolutions of a chopper will sooner or later drop and this may clog the chipping device or may even stop the machine. It is quite uneconomical to employ machines which are sufficiently powerful so that they are capable of continuously chipping even very heavy timber in the field. Therefore, as the number of revolutions of a chopper falls to and even below critical value the feed of the timber must be interrupted so that the machine can gain speed again and the number of revolutions is thus allowed to return towards normal value. Unless a chopper operator controls the feeding by manual controls or otherwise, automatic operation is to be provided for. However, automatic feed interrupting devices are not generally used due to certain drawbacks in their operation and due to complicated design considerations. In order to insure a reliable feed of timber, the tool of a chopper is nearly always made self-feeding or at least this is the objective for a reliable machine. In other words the cutting direction is chosen such that the cutters pull the log in the feeding direction while frictionally engaging the log pursuant to the chipping operation. The feeders are usually of a roller or chain type and there is an inherent delay in that it may not always be sufficient to rapidly stop the operation. Thus, the cutters may pull the log even though the feeder has stopped.

DESCRIPTION OF THE INVENTION

It is an object of the present invention to provide a new and improved method of chipping a wooden log by means of intermittently operating a chipping cutter, but under conditions which avoid the drawbacks outlined above. In accordance with the preferred embodiment of the present invention, it is suggested to hold the log to be fed firmly and to alternate in intermittent cycles between feeding the log towards the cutter and positively retracting the log therefrom.

In the preferred embodiment, moreover, the chopper or chipping device includes a plurality of cutters such as knives but the spacing of the cutters from each other is substantially greater than the distance the knife travels upon traversing the log. Thus, each chipping cycle of the knife or cutter is followed by an interval or period during which no knife or cutter engages the log. Thus, during this interval, pause or waiting period, the self-feeding of the rotating cutter is not, in fact, in operation and the device holding the log is free to move it backwards beyond the reach of the cutter. Jerking the log loose in this fashion can simply be effected by an electrically controlled reversing valve controlling hydraulic drives which provide for the immediate feed. In addition, the pause between feeding or the duration of the retraction may be established by means of a time delay device which takes into consideration the normal rotational speed of the cutter and the angular spacing between the cutting knife. The time delay relay is known per se and is turned on to provide a current pulse of desired length to the reversing control for the log feed while the control for the forward feed is turned off.

It can thus be seen that through these comparatively simple measures of alternating between positive forward motion of the log and positive retraction of the log from the cutter, the overall operation becomes highly reliable and trouble-free.

DESCRIPTION OF THE DRAWINGS

While the specification concludes with claims particularly pointing out and distinctly claiming the subject matter which is regarded as the invention, it is believed that the invention, the objects and features of the invention, and further objects, features and advantages thereof will be better understood from the following description taken in connection with the accompanying drawings in which:

FIG. 2 is a side elevation of the structure shown in FIG. 1;

FIG. 4 illustrates a block diagram for the control circuit that operates the log feed mechanism and device shown in the several Figures.

Proceeding now to the detailed description of the drawings, a wooden log 1 to be chopped and chipped is fed at an acute angle against a cutter wheel 2 in such a manner that upon engagement of the log by the knives 3 of the cutting wheel the cutter structure as a whole pulls the log in the direction of feeding as illustrated by the arrow on the log. A counter edge 4 holds the log laterally in position. Whenever one of the knives 3 has completed its cutting, chipping, and working stroke, it has traversed the distance B in FIG. 3 from the instant of engagement. Thereupon, a pause or interval occurs in the chopping operation until the next knive engages the log. During this period, the log can readily be pulled back from the cutter. The drawings, and particularly FIG. 3, are not horizontally quite to scale because the distance A from cutter knife to cutter knife is at least two, maybe up to four, times the distance in spacing of the chipping distance B. Therefore, the pause cycle is longer than the cutting cycle proper in each instance. This means that sufficient time is available for purposes of causing the log 1 to be retracted.

Figure 1:
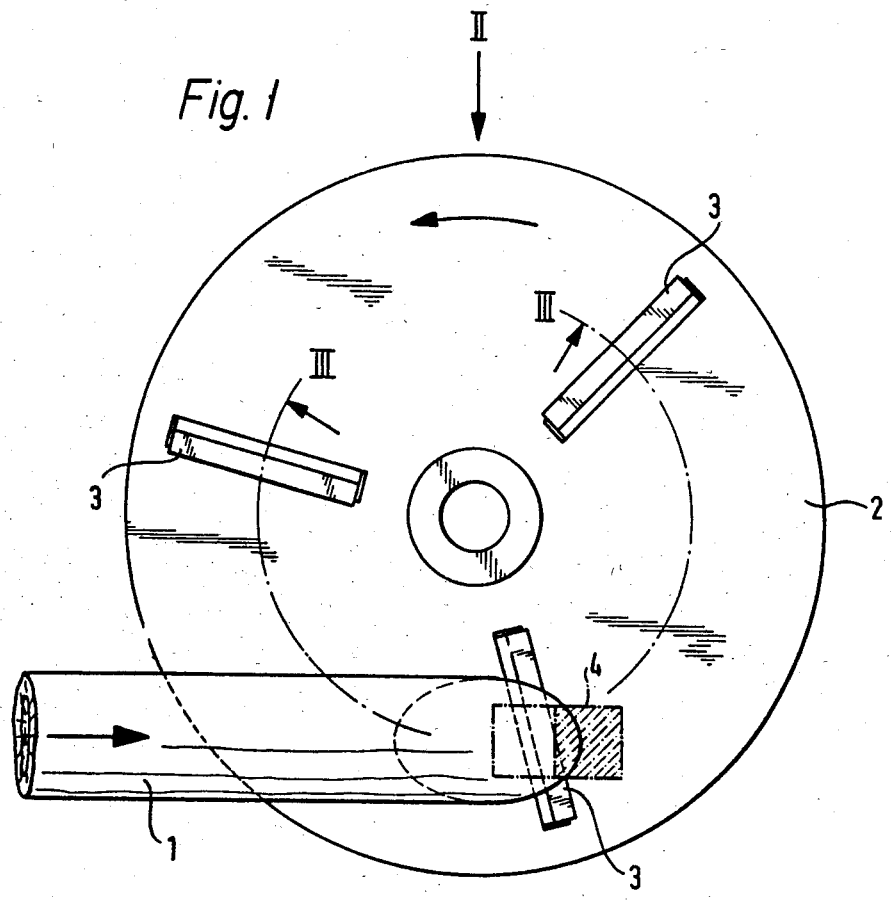
FIG. 1 is a top elevation of a three knife cutter on a wheel arranged in a vertical direction and showing also a log to be fed to the cutter.
Figure 3:
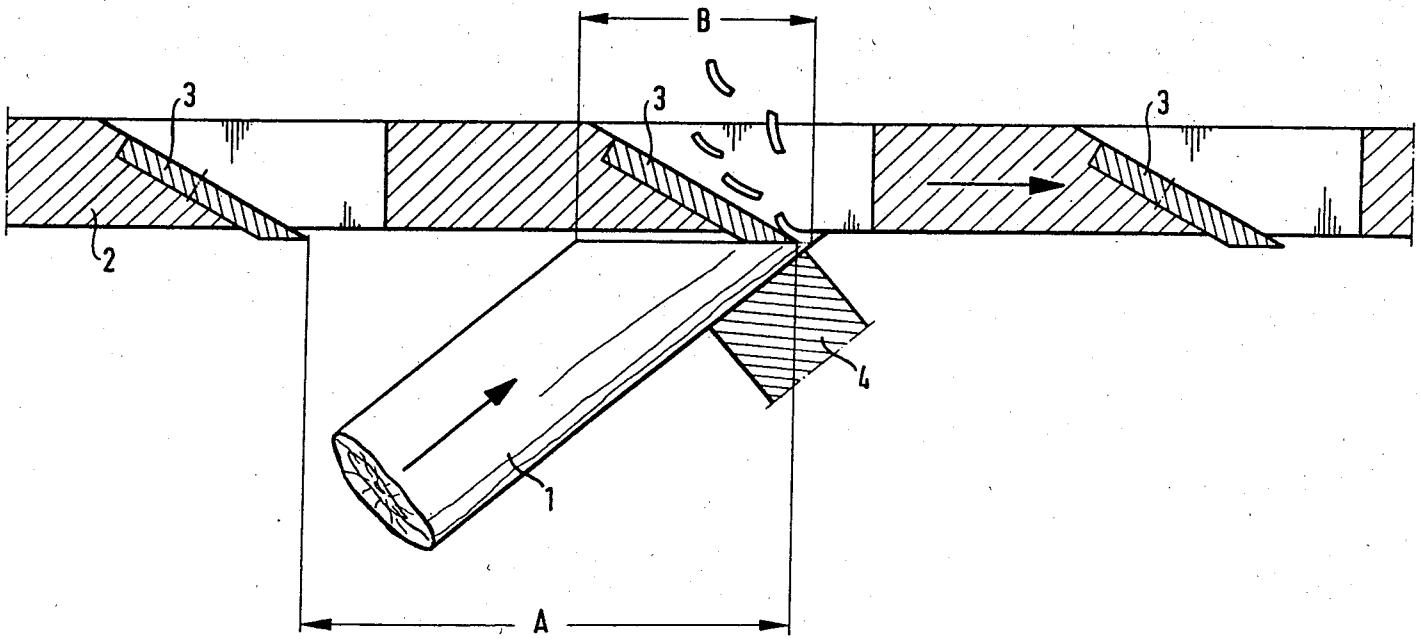
FIG. 3 is a development of the geometry involved in the cutting wheel and can be understood to be a section taken along line III=III in FIG. 1.

The feed mechanism involved includes a pair of traction rollers 10 and 11 engaging the log 1 and being respectively driven by hydraulic motors 12 and 13. The motors 12 and 13 are simultaneously under control of electrohydraulic valves 25 whose operating member can be shifted in one direction by operation of the coil 26 hereinafter called the feed coil, while motion in the opposite direction is affected by energization of the coil 27, hereinafter called the breaking or reverse coil. When neither coil is energized, springs center the valve in a middle position in which the hydraulic motors 12 and 13 are unenergized. The illustrated position of the valve, the motors 12 and 13 drive the rollers 10 and 11 such that the log 1 is advanced towards the cutting disk 2. Accordingly, energization of reverse coil 27 is required in order to retract the log from the cutting wheel.

The control circuit includes a three position switch 21 by means of which a normal feed operation can be obtained which within the context of this invention means an automatic alternation between feed and reversing cycle. The middle position 21*b* of the switch 21 is provided as neutral or off position and when switch 21 is in the third position 21*c*, the hydraulic valve 25 will be placed in the position of full retraction. In addition, the circuit includes an on/off switch 23 as far as automatic operation is concerned. This position is illustrated in the drawing. In the alternative position, the switch 23 simply connects permanently the feed coil 26 so the power supply line 20 provided the switch 21 is in the illustrated position 21*a* and now the coil 26 remains permanently energized. The circuit includes, furthermore, the automatic feed/brake circuit 22 for obtaining forward feed operation with coil 26. The time relay 29 determines the duration of reversing motion via coil 27.

The operation of the device as illustrated is as follows:

To start the operation, the feed/stop/reverse operating switch 21 is turned on to its feed position 21*a* from its middle stop position 21*b* . Supposing that the automatic feed braking is on (on/off switch 23 of automatic feed braking is in its position shown in the drawing), the feed coil 26 of hydraulic valve 25 is energized through automatic feed-braking unit 22, and the valve 25 is turned (by the feed coil 26) from its middle stop position to the feed position shown in the drawing. Speed of rotation of the cutter wheel 2 is detected by an impulse counter 28 or tachometer. By using an impulse counter also the phase of the position of the blade 3 can be detected.

If the automatic feed-braking unit 22 receives a speed signal which is below a predetermined speed signal, the feed-braking unit 22 de-energizes the feed coil 26 in that the switch in the unit 22 turns off and simultaneously the control current from this unit to time relay 29 is cut off, and the switch in the time relay is closed for a predetermined time interval, which is set in the time relay 29. Through the closed switch of the time relay 29 the current runs to energize the reverse coil 27, which causes valve 25 to change its position to the reverse running position of the hydraulic drive motors 12 and 13 of the feeding rollers 10 and 11. After the predetermined time set in the time relay 29 has expired, the switch of the time relay 29 opens for de-energizing the reverse coil 27. This predetermined time determines the rate of reverse movement. Valve 25 is automatically, i.e. by means of springs, returned to its middle stopping position, and it will remain in this position until the automatic feed braking unit receives a speed signal from circuit 28 indicating that a predetermined speed of rotation is exceeded whereupon the switch in the feed-braking unit 22 is closed again to re-energize the feed coil 26, which returns the valve 25 to its feed position as illustrated. These operations take place within the period A following a period or chipping cycle B.

Alternatively (but not in the best mode of invention) the feed can be returned by a timing means after a predetermined time interval, which exceeds the reverse movement time interval. Such a timing means can be placed in the feed braking unit or in the time relay, from which a control line (not shown) is connected to feed-braking unit is connected.

This alternative is feasible, since normally it takes a predetermined time to sufficiently add the speed of an unloaded cutter wheel from said predetermined lower speed to a sufficient operating speed.

Each impulse of the impulse detector is received at such a phase of the cutter wheel rotation that, taking into account the delay of the control circuitry and inertia of the movable means, the reverse movement of feeding rollers begins immediately after the blade has passed the log end.

The automatic feed braking 22 can be bypassed by the on/off switch 23 whereby in the second position of this switch the feed is continuously on. Independently of the position of this on/off switch 23, the drive 12, 13 of feeding rollers 10, 11 can be stopped and reversed by the manually operated feed/stop/reverse operating switch 21, then placed into the third position 21*c*.

The terminal of the current source are coupled to ground whereby the electronic operating units and devices are powered by the current and voltage across the shown current line and ground, which can be realized by connecting all the metal shields and bodies of the electronic devices together with the grounded terminal.

The invention is not limited to the embodiments described above, but all changes and modifications thereof, not constituting departures from the spirit and scope of the invention ar intended to be included.

I claim:

1. A chopping apparatus comprising:

a rotatable wheel or disk carrying a plurality of cutters;

a pair of traction rollers for engaging a log and feeding the same at an oblique angle towards a cutter disk for obtaining a chopping and chipping of the log;

a pair of motors respectively for operating said rollers in a forward and in reverse mode;

control means for operating said motors respectively in the forward and reverse mode whereby the reverse mode is alternatingly interspersed in between sequential forward motion cycles to bridge a period of time in between sequential engagements of the log by the cutters;

said control means including a feed-braking unit provided for the forward mode, the feed braking unit being connected when energized to operate said motors in the forward mode; and speed drop responsive means and manual means connected for deenergizing the feed braking unit thereby triggering a timing means, said timing means being connected and operating for causing the motors to run in the reverse for a specified period of time inherent in the timing means.

2. Apparatus as in claim 1, the motors being hydraulic engines, the control means including an electric valve and a time relay for metering the duration of the reverse mode.

3. Apparatus as in claim 1, the control means including cutter speed dependent means for controlling the onset or restauration of the forward mode.

* * * * *